United States Patent [19]

Moiroux

[11] 4,273,083

[45] Jun. 16, 1981

[54] DISTRIBUTION SYSTEM FOR THE INTAKE AND EXHAUST OF A SUPER CHARGED INTERNAL COMBUSTION ENGINE

[76] Inventor: Auguste Moiroux, 28 Route de Dardilly, Ecully, (Rhone), France

[21] Appl. No.: 871,825

[22] Filed: Jan. 24, 1978

[30] Foreign Application Priority Data

May 16, 1977 [FR] France ..... 77 16035

[51] Int. Cl.[3] ..... F01L 1/28

[52] U.S. Cl. ..... 123/79 R; 123/76

[58] Field of Search ..... 123/76, 81 R, 190 A, 123/79 R

[56] References Cited

U.S. PATENT DOCUMENTS

| | | | |
|---|---|---|---|
| 1,323,445 | 12/1919 | Boyce | 123/79 R |
| 1,397,585 | 11/1921 | James | 123/79 R |
| 1,418,209 | 5/1922 | Smith | 123/79 R |
| 1,476,359 | 12/1923 | Ford | 123/79 R |
| 1,880,609 | 10/1932 | Vincent | 123/79 R |
| 1,985,528 | 12/1934 | Taheld et al. | 123/79 R |
| 2,127,692 | 8/1938 | Lothrop | 123/79 R |
| 2,215,579 | 9/1940 | Eichelberg | 123/79 R |
| 2,416,512 | 2/1947 | Boorer | 123/79 R |
| 2,742,028 | 4/1956 | Robinson | 123/79 R |
| 3,097,633 | 7/1963 | Klein | 123/79 R |

FOREIGN PATENT DOCUMENTS

| | | | |
|---|---|---|---|
| 248278 | 5/1926 | Italy | 123/79 R |
| 5814 | of 1896 | United Kingdom | 123/79 R |

*Primary Examiner*—Charles J. Myhre
*Assistant Examiner*—W. Wolfe
*Attorney, Agent, or Firm*—Irving M. Weiner; Pamela S. Burt; John L. Shortley

[57] ABSTRACT

The invention relates to a distribution system for the intake and exhaust in an internal combustion engine.

According to the invention, a cylinder is connected to an exhaust manifold by means of a connecting valve 10. An intake mainfold 10 opens into the manifold 14 by means of an intake valve 14 making it possible to regulate the flow of air and re-cycling of the burnt gases.

The advantages attained by the invention include: achieving optimum characteristics of the flow of air and re-cycling of the burnt gases, obtaining optimum characteristics of the flow, reduction in temperature of the exhaust valve and assisting in starting and partial running.

11 Claims, 7 Drawing Figures

DISTRIBUTION SYSTEM FOR THE INTAKE AND EXHAUST OF A SUPER CHARGED INTERNAL COMBUSTION ENGINE

BACKGROUND OF THE INVENTION

The present invention relates to a distribution system for the intake and exhaust of an internal combustion engine and in particular for a supercharged diesel engine.

All current reciprocating internal combustion engines are provided with an active fluid circuit which comprises an intake extending as far as the intake valve and an exhaust circuit which begins at the exhaust valve. Consequently, the engine is mounted in series in the active fluid circuit. The following consequences are the result of this situation:

The circuit passing through the engine itself is established in an exact manner during the intake and scavenging period, i.e. for a predetermined period of time. Adjusting the rate of flow of the turbo-blower for supercharging the engine is therefore limited and may cause problems at the time of high supercharging.

The exhaust valve essentially deals with gases burnt at a high temperature and therefore itself reaches a high temperature which promotes corrosion and thermal cracking.

The present invention provides a distribution system which eliminates these drawbacks.

SUMMARY OF THE INVENTION

A distribution system according to the invention, for the distribution of fresh air and burnt gases in a reciprocating engine, is characterized in that the flow of active fluid is in parallel and not in series with the engine and is connected to the latter by a single connecting valve.

According to an additional feature of the invention, each cylinder is equipped with at least one connecting valve having a double intake and exhaust function.

According to an additional feature of the invention, the engine is a diesel engine supercharged by means of a turbo-blower.

According to an additional feature of the invention, the flow of the turbo-blower is sufficiently powerful to prevent burnt gases from returning upstream.

According to an additional feature of the invention, a non-return valve is placed on the outer circuit, upstream of the connecting valve, in order to prevent the return of burnt gases.

According to an additional feature of the invention, a distribution valve, located in front of the connecting valve and controlled in order to check the flow of air of the turbo-blower, makes it possible to prevent the return of burnt gases.

According to a variation of the invention, the intake manifold opens into the exhaust manifold by means of a closure member constituted by an oscillating flap valve able to move between two extreme positions in which it respectively closes-off the intake manifold and the exhaust manifold downstream of the point where the intake manifold opens out.

According to an additional feature of the invention, the flap valve is mounted to oscillate about a spindle and its moving edge moves in the vicinity of a stationary deflector which extends as far as the immediate vicinity of the connecting valve, such that during the movement of the oscillating flap valve between its two extreme positions, a position of said flap valve exists, according to which it is located substantially in the extension of the stationary deflector, i.e., according to which the intake manifold and exhaust manifold are each provisionally extended separately as far as the immediate vicinity of the connecting valve.

According to an additional feature of the invention, the flap valve is connected to a control device designed such that said flap valve passes only progressively from the position in which it closes-off the intake manifold into the position in which it closes-off the exhaust manifold, such that when the flap valve substantially forms an extension of the stationary deflector, the intake air penetrates the cylinder by passing from one side of the deflector, drives the burnt gases from the dead space of the cylinder and leaves the cylinder by passing on the other side of the deflector.

According to an additional feature of the invention, the device for controlling the oscillating flap valve is provided such that said flap valve passes from the position in which it closes-off the exhaust manifold into the position in which it closes-off the intake manifold solely when the connecting valve is closed.

The accompanying drawings, given as a non-limiting example, illustrate the features of the invention.

DETAILED DESCRIPTION

Figure 1:
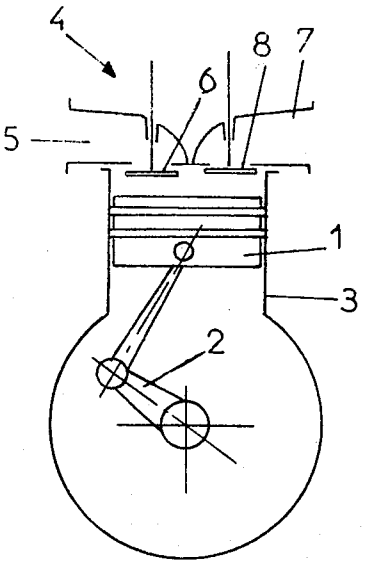
FIG. 1 is a diagrammatic axial section of a conventional engine cylinder.

FIG. 1 shows an engine of conventional type with a piston 1 mounted on connecting rod bearings 2 for moving inside a cylinder 3. The cylinder 3 is surmounted by a cylinder-head 4 which contains an intake chamber 5 controlled by a valve 6 and an exhaust chamber 7 controlled by a valve 8.

In an engine equipped according to the invention (FIG. 2), the cylinder-head 9 contains an intake manifold 10 and an exhaust manifold 11 connected directly to each other by means of a simple non-return valve 12. The exhaust manifold 11 can be connected to the cylinder by a connecting valve 13 controlled by a cam shaft which is not shown.

The operation is as follows.

As soon as the piston reaches the end of the power stroke, at the bottom dead center, the connecting valve 13 opens and the gases can be driven into the exhaust manifold 11. The valve 12 prevents them from passing upstream in the intake manifold 10.

At the end of the exhaust phase, when the piston 1 is at the top dead center, the exhaust gases no longer produce excess pressure in the manifold 11, such that the valve 12 opens to allow the passage of air coming from the supercharging blower. When the piston 1 re-descends, it is thus able to draw in fresh air coming from the intake manifold 10. At this time, this fresh air drives back the burnt gases in the exhaust manifold 11.

When the piston reaches the bottom dead center, the connecting valve 13 once more closes. The cycle including compression, combustion and the power stroke thus takes place in the cylinder in a conventional manner whilst the valve 12 allows the passage of the excess supercharging air returning to the turbo-blower, as will be seen hereafter.

Figure 3:
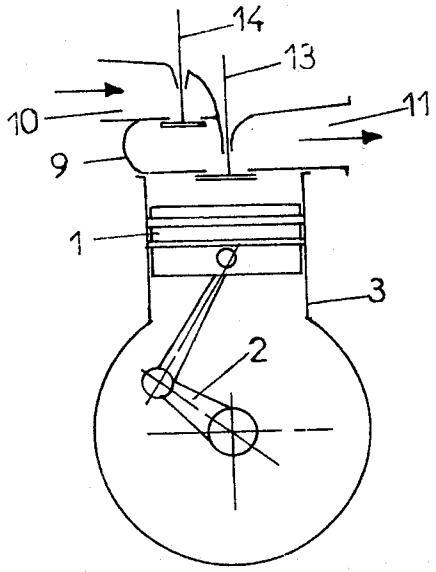
FIG. 3 is a diagrammatic axial section of an engine cylinder provided with a distribution system according to the invention, with a connecting valve and a controlled distribution valve.
Figure 2:
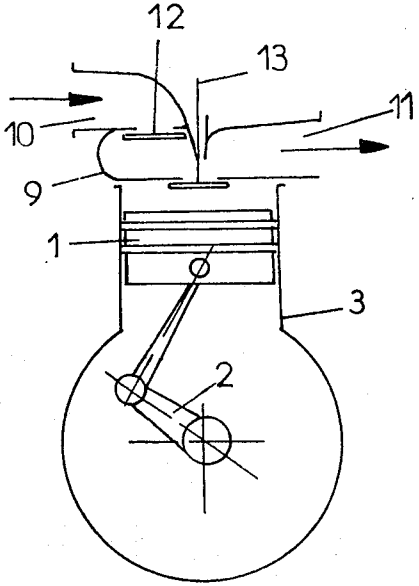
FIG. 2 is a diagrammatic axial section of an engine cylinder provided with a distribution system according to the invention, with a connecting valve and a non-return valve.

FIG. 3 shows an engine comprising exactly the same parts as that of FIG. 2, with the sole difference of the non-return valve 12, which is removed and replaced by an intake valve 14 controlled by the cam shaft which is not shown.

The operation remains substantially the same, but the distribution or intake valve 14 opens in a controlled manner slightly before the top dead center at the end of the exhaust phase in order to prevent sucking back the burnt gases. The valve 14 closes either at the same time as the valve 13, or thereafter, in order to allow the passage of a possible excess quantity of air.

Figure 4:
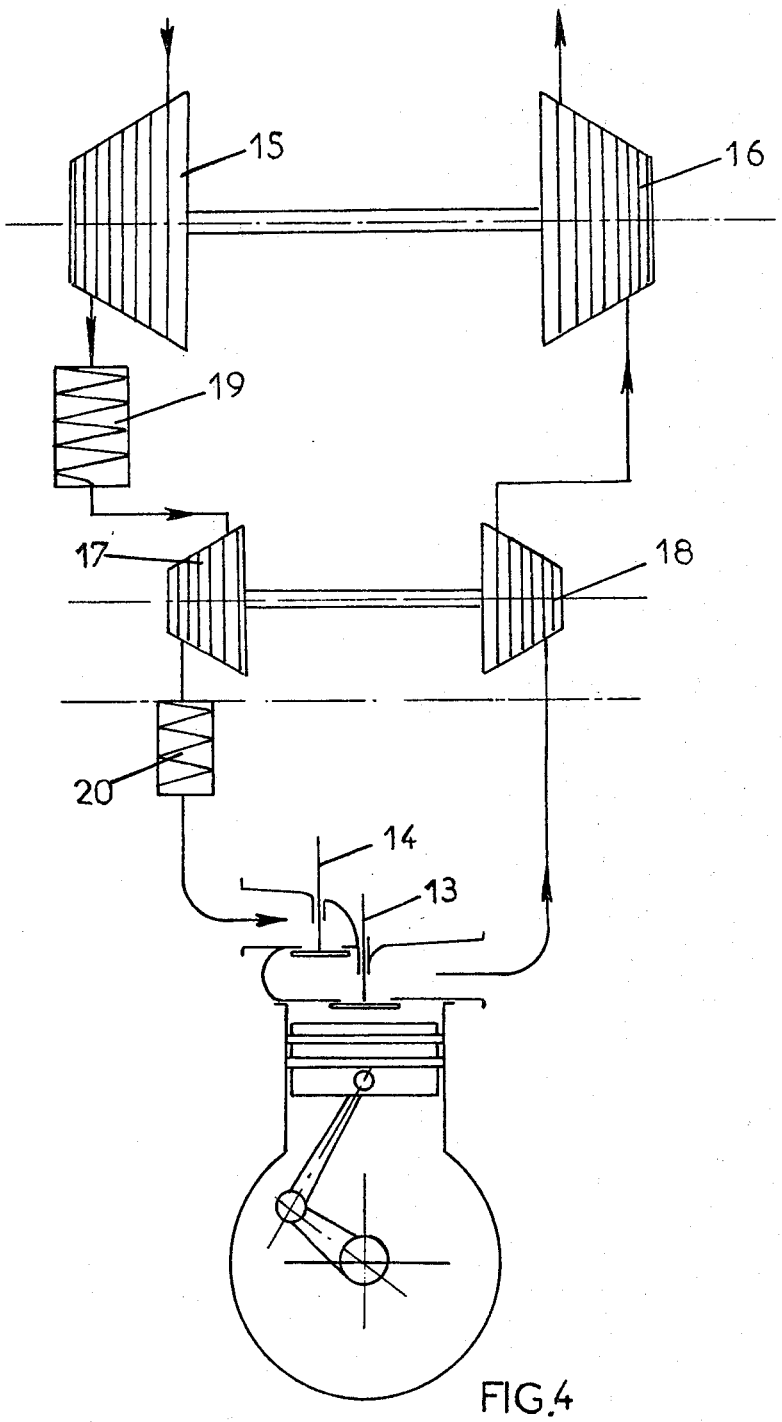
FIG. 4 is a diagrammatic view showing the distribution system illustrated in FIG. 3, adapted to a highly supercharged engine.

FIG. 4 shows the engine of FIG. 3 associated with a two-stage high pressure supercharging turbo-blower arrangement, with a low pressure compressor 15 driven by a low pressure turbine 16 and a high pressure compressor 17 driven by a high pressure turbine 18. Intermediate devices 19 and 20 ensure cooling of the air.

The operation still remains substantially the same, but the valve 14 opens with a slight delay at the time of starting of the engine, which has the effect of voluntarily sucking back the burnt gases into the engine and heating the air in the cylinder whilst allowing ignition with the low rate of compression used in supercharged engines.

As soon as the engine has started, opening of the valve 14 is once more adjusted normally in order to prevent re-cycling of the burnt gases.

It is also possible to maintain the delay on closing the valve 14 during idling periods. Smoother combustion is thus obtained, since the cycle takes place at a higher temperature with reduced ignition delays.

The distribution system according to the invention comprises the following advantages in particular:

It is possible to adapt the characteristics of the turbo-blowers to the engine in an ideal manner, i.e., to adapt the delivery as a function of the pressure. For this it is sufficient to adjust the point of closure of the valve 14. The operation of the engine is in no way impaired.

The connecting valve 13 is successively scavenged by the hot exhaust gases, then by the fresh intake air. It is therefore well cooled and thus ceases to be a fragile member which deteriorates easily.

The cylinder-head has a simpler construction, since it comprises only one valve per cylinder instead of two. The valve 14, relatively remote from the cylinder, causes no problems as regards positioning or bulk.

Figure 7:
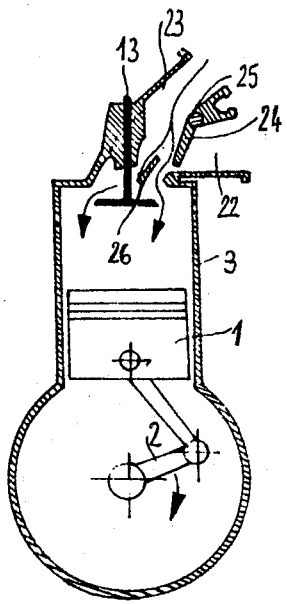
FIGS. 5 to 7 are diagrammatic axial sections of an engine cylinder provided with a distribution system according to a variation of the invention.
Figure 6:
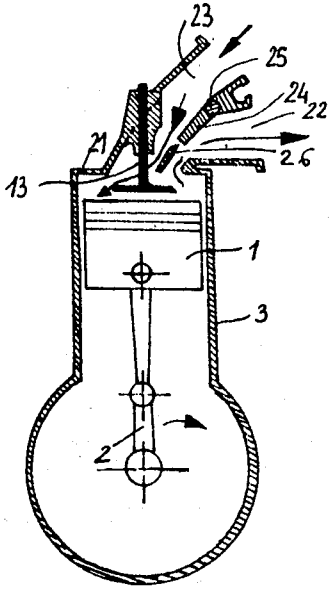
Figure 5:
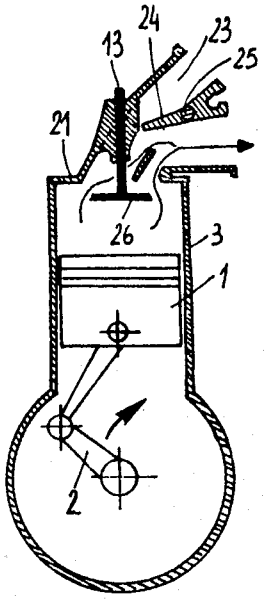

According to a variation of the invention, illustrated in FIGS. 5 to 7, the chamber of the valve 13 directly extends the exhaust manifold 22 into which the intake manifold 23 opens. An oscillating flap valve 24 is housed in the exhaust manifold. This flap valve 24 is integral with a control spindle 25 which moves it between two extreme positions. In the first extreme position (FIG. 5), the flap valve 24 closes-off the intake manifold 23. In its second extreme position (FIG. 7), the flap valve 24 closes-off the exhaust manifold 22 downstream of the point where the intake manifold 23 opens out.

A deflector 26 is also housed in the chamber of the connecting valve 13. One of the edges of the deflector 26 is adjacent the moving edge of the flap valve 24. The other edge of the deflector 26 is located in the immediate vicinity of the connecting valve 13. It will also be noted that the arrangement is designed such that there is an intermediate position of the flap valve 24, in which the latter substantially extends the stationary deflector 26 (FIG. 6).

The operation is as follows.

When the exhaust phase begins for the cylinder in question, the flap valve is in its first extreme position (FIG. 5), the connecting valve 13 opens and the burnt gases escape in the direction of the manifold 23 by making use of the entire inner space of the chamber of the valve 13.

When the piston 1 reaches its upper position, i.e., when the exhaust phase is completed, the flap valve 24 which is still driven by the control spindle 25 passes progressively from the first position to the second end position. This movement is relatively progressive and the flap valve 24 thus passes through the intermediate position shown in FIG. 6 and in which the scavenging air coming from the intake manifold 23 passes into the chamber of the valve 13, from one side of the stationary deflector 26, penetrates the dead space of the cylinder and pushes back the burnt gases located therein. These burnt gases pass into the valve chamber on the other side of the deflector 26 and escape through the exhaust manifold 22.

It will be understood that scavenging of the cylinder is as effective as in a cylinder comprising separate connecting valves for the intake and exhaust.

The flap valve 24 then reaches its second extreme position shown in FIG. 7, thus clearing the entire section of the chamber, in order to allow the intake air to fill the cylinder.

When the piston 1 reaches its bottom dead center, the valve 13 closes and the power cycle may begin.

The flap valve 24 moves from its second extreme position to its first extreme position during the time which elapses between the instant when the valve 13 closes and the instant when it re-opens for a further exhaust operation. This movement is carried out at an adjustable speed. This speed depends on the leakage of air which is desirable to tolerate. There is thus a possibility of adapting the delivery of the turbo-blower to the characteristics of the engine.

If, with a low load, one wishes to obtain a certain recirculation of the burnt gases to facilitate ignition, for this it is sufficient to open the flap valve 24 sooner in order that the exhaust gases penetrate the intake circuit slightly.

In certain cases, the control of the oscillating flap valve 24 will be achieved simply by a return spring which permanently biases said valve into the position in which it closes-off the intake manifold. In this case, the flap valve is also subject to the action of a buffer limiting the speed of its movements. The operation remains substantially the same: when the exhaust phase is completed, the flap valve 24 passes from the first to the second position under the effect of the thrust of the intake air. When the piston 1 reaches its bottom dead center and the valve 13 closes, the return spring ensures the return of the flap valve to the first position.

I claim:

1. A system for the distribution of fresh air and burnt gases in a reciprocating internal combustion engine, said engine having an exhaust manifold, an intake manifold, a cylinder and a cylinder head wherein:

a flow of active fluid is directed to said cylinder and is in part parallel with said cylinder, and is connected to said cylinder by a connecting valve;

said cylinder head including said exhaust manifold, with said exhaust manifold being opposite said cylinder, and extending substantially directly above said cylinder and being connected to said cylinder by said connecting valve;

said intake manifold being supplied with air by a supercharging turbo-compressor and being connectable to said exhaust manifold by a second valve;

said second valve which connects said intake manifold to said exhaust manifold being disposed at a distance from said connecting valve, wherein;

said second valve is disposed downstream of said connecting valve with respect to the exhaust gas manifold in one position, wherein;

said second valve by means of which said intake manifold opens into said exhaust manifold comprises an oscillating flap valve which is movable between two extreme positions in which it respectively closes-off said intake manifold and said exhaust manifold; and wherein:

said flap valve comprises a movable edge which moves in the vicinity of a first edge of a stationary deflector of the chamber of said connecting valve, the second edge of said deflector being disposed in the immediate vicinity of said connecting valve, such that during movement of said oscillating valve between the two extreme positions thereof there is an intermediate position of said flap valve in which it substantially forms an extension of said stationary deflector, whereby said intake manifold and exhaust manifold are both provisionally extended separately as far as the immediate vicinity of said connecting valve, on either side of said flap valve and of said deflector.

2. A system according to claim 1, wherein:

said flap valve is mounted to rotate about a control spindle which sets said flap valve in oscillation.

3. A system according to claim 1, wherein:

said flap valve is connected to a control device designed such that said flap valve passes only progressively from the position in which it closes-off said intake manifold to the position in which it closes-off said exhaust manifold such that the scavenging air coming from said intake manifold drives the burnt gases from the dead space of said cylinder in order to send them into said exhaust manifold at the end of the exhaust phase, at the time when said flap valve passes through the intermediate position thereof.

4. A system according to claim 3, wherein:

said device for controlling said oscillating flap valve is provided such that said flap valve passes from the position in which it closes-off said exhaust manifold into the position in which it closes-off said intake manifold only when said connecting valve is closed.

5. A system according to claim 3 or 4, wherein:

said flap valve is subjected on the one hand to the action of a return spring which permanently biases it into the position in which it closes-off said intake manifold, and on the other hand to the action of a buffer limiting the speed of its movements, said return spring and said buffer ensuring the control of said oscillating flap valve.

6. A system according to claim 1, wherein:

said second valve is disposed upstream with respect to said connecting valve and to the exhaust gas manifold in another position.

7. A system according to claim 6, wherein:

said system is mounted on an engine of the supercharged diesel type.

8. A system according to claim 6, wherein:

the flow of intake air is sufficiently powerful to prevent the return of burnt gases to the intake manifold.

9. A system according to claim 6, wherein:

the return of burnt gases to the intake manifold is prevented by means of said second valve member, said second valve member comprising a simple non-return valve.

10. A system according to claim 6, wherein:

the return of the burnt gases to the intake manifold is prevented by means of said second valve member, said second valve member comprising a control valve disposed in the intake circuit.

11. A system according to claim 10, wherein:

the opening and closing points of said control valve are adjustable to facilitate optimum operating conditions.

* * * * *